US007464416B2

(12) United States Patent
Last

(10) Patent No.: US 7,464,416 B2
(45) Date of Patent: Dec. 16, 2008

(54) PASSIVE TENSIONING MECHANISM FOR UNDERWATER BUOYANT-SLAT AUTOMATIC POOL COVER SYSTEMS

(76) Inventor: Harry J. Last, 1010 KOOHOO Pl., Kailua, HI (US) 96734

( * ) Notice: Subject to any disclaimer, the term of this patent is extended or adjusted under 35 U.S.C. 154(b) by 0 days.

(21) Appl. No.: 11/940,513

(22) Filed: Nov. 15, 2007

(65) Prior Publication Data

US 2008/0060126 A1 Mar. 13, 2008

Related U.S. Application Data

(62) Division of application No. 10/980,533, filed on Nov. 3, 2004, now Pat. No. 7,409,732.

(60) Provisional application No. 60/517,053, filed on Nov. 11, 2003, provisional application No. 60/517,246, filed on Nov. 11, 2003.

(51) Int. Cl.
*E04H 4/00* (2006.01)

(52) U.S. Cl. ..... 4/502; 4/498; 4/501; 4/503
(58) Field of Classification Search ..... 4/498–503
See application file for complete search history.

(56) References Cited

U.S. PATENT DOCUMENTS 3,613,126 A * 10/1971 Granderath ..... 4/502
2003/0213057 A1* 11/2003 Poirson ..... 4/502

FOREIGN PATENT DOCUMENTS

FR 2326558 * 2/1974
FR 2577264 A1 * 8/1986 ..... 4/502
FR 2888266 * 1/2008

* cited by examiner

*Primary Examiner*—Khoa D Huynh
(74) *Attorney, Agent, or Firm*—David E. Newhouse, Esq.

(57) ABSTRACT

Invented techniques and associated mechanisms are described for passively assuring that the spiraling layers of wound-up layers of a buoyant pool cover are, and will remain tightly wound around a rotatable cover drum completely submerged in a pool bottom tough.

2 Claims, 4 Drawing Sheets

PASSIVE TENSIONING MECHANISM FOR UNDERWATER BUOYANT-SLAT AUTOMATIC POOL COVER SYSTEMS

RELATED APPLICATIONS

This application is a Divisional application of U.S. patent application Ser. No. 10/980,533 filed 3 Nov. 2004, now U.S. Pat. No. 7,409,723, pursuant 35 U.S.C. § 121, and relates to U.S. Provisional Patent Application Ser. Nos. 60/517,053 and 60/517,246 filed Nov. 11, 2003. The entirety of each referenced application is incorporated herein by reference and claims any and all benefits to which it is entitled to thereby.

BACKGROUND OF THE INVENTION

1. Field of the Invention

These inventions relate to buoyant-slat automatic pool cover systems and tuning techniques harnessing buoyancy forces for optimizing and overcoming inherent functional deficiencies in such systems.

2. Description of the Prior Art

Automatic pool cover systems utilizing interconnected rigid buoyant slats described in U.S. Pat. No. 3,613,126, R. Granderath, which roll up on a submerged or elevated drum are popular in Europe. Such buoyant slat pool cover systems for non-rectangular shaped pools have covers which emerge from covered troughs below the pool bottom in the center of a pool and extend to the pool ends. [See EPO 0369038 A1 & B1, R. Granderath and DE 19807576 A1, K. Frey.] Descriptions of typical buoyant slats for such pool cover systems are described in U.S. Pat. No. 4,577,352, Gautheron, and in U.S. Pat. No. 5,732,846, Helge, Hans-Heinz (See also DE 4101727 and EPO 225862 A1.)

U.S. Pat. No. 4,411,031 Stolar describes a pool cover system similar to Granderath where, instead of rigid, hinged buoyant-slats, various floating sheet materials such as a polyethylene poly-bubble, or a laminate of vinyl sheeting and foamed substrate, are floated onto the surface of the pool water. Similar to Granderath, extension of Stolar type covers across pools is reliant on buoyant and gravitational forces.

The disadvantage of buoyant pool cover systems utilizing passive buoyancy or gravity forces for propelling or extending the cover components across a pool surface is that the passive forces are always present, and must be dealt with when the cover is stored fully wound up around the cover drum underneath the pool surface, when the cover unwinds from around the drum on extension, and when the cover winds up around the drum on retraction.

Pool cover systems that use buoyancy to propel floating covers across the pool, most typically wind the cover onto roller drums positioned below the water surface. When the cover is retracted from the pool surface and fully wound up onto the cover drum, the upper extremity or front/leading edge of the cover typically is at least two inches below the water surface of the pool. In some cases, the wound up cover and drum are located in a trough next to the pool. In other cases, the cover and drum may be located in an enclosure near the bottom of the pool, or in a special hidden trough compartment underneath the pool floor aesthetically hiding the cover and roller drum. In all cases, the cover drum mechanism is usually located or covered so that that swimmers and the mechanism cannot interfere with each other.

When a buoyant cover is wound up around the cover drum, underwater buoyancy forces act on both sides of the wound up cover with the cover drum acting as a pivot tending to turn in the direction on the side with the greater force. Accordingly, when the cover is fully retracted, the cover drum must be held stationary. An even more perplexing problem is that buoyancy forces tend to unwind the spirally wound up layers of the cover from around the cover drum, particularly in instances where the tongue or front portion of the cover has less volume (is less buoyant) than the main body cover. Typically, the front end of the cover is not secured when the cover is fully wound up in the retracted storage position. Accordingly, when the outer cover layer on the winding side of the cover drum is more buoyant than the outer cover layer on the extending side of the cover drum, the imbalance of buoyancy between the winding side and extension side with the cover drum held stationary, will pull the front portion of the cover around the wound cover layers in the winding direction, successively until the buoyancy forces on the respective sides (layers) of the cover roll balance (reach an equilibrium). Such passive unwinding or loosening of the retracted cover in the cover drum trough increases the cover roll radius leading to jams when that radius reaches or exceeds a design parameter such as a trough wall. Also such loosening effectively precludes limit switch control over cover extension.

The typical buoyant-slat for a pool cover has a transparent upper or top surface and a dark bottom or undersurface (See U.S. Pat. No. 5,732,846, Helge, col. 1, ll 27-34), The slat is a typically an extruded plastic tube with one or more stoppered, air filled longitudinal flotation chambers, having a longitudinal male, prong hook along one side and a longitudinal female prong-receiving channel along its other side [See FIG. 1]. A plurality of slats are interleaved together to form flexible or rollup-able cover. Buoyant pool cover slats are also quite vulnerable to over heating, i.e., heat increases air pressure in the flotation chambers that can compromise the water tightness of the slat. Water convection cools the dark undersides of the slats forming the cover when the cover is deployed on a pool surface.

The coupling between adjacent coupled slats is essentially a loose, longitudinal, bidirectional hinge that is flexible or bendable back and forth around the longitudinal coupling. The longitudinal prong-channel couplings between adjacent slats are typically configured to allow the longitudinal coupling to flex, with reference to a horizontal floating plane of a pool surface, in an underside direction and in a topside direction. The degree of topside and underside flexibility of the coupling between adjacent buoyant slats cover determines both the direction the cover is wound and the minimum diameter of the cover drum. Typically, the longitudinal couplings of the type shown in FIG. 1 allow a 30° topside flex and a 45° underside flex.

Under most circumstances, buoyancy forces keep the longitudinal couplings between adjacent slats in tension underwater until the couplings reach the pool surface. At the pool surface, tensioning due to buoyancy disappears allowing the coupling to unpredictably flex in opposite (topside-underside) directions. Such bidirectional flexing is a problem as the front or leading edge of the buoyant cover, on extension, emerges up through onto the horizontal surface of the pool unguided [See DE19807576 A1, K. Frey.] In particular, a myriad of different factors, e.g., momentum, wind, surface waves, and the like, all can affect the direction the front edge of the cover flexes. For example, the front edge of the cover emerging adjacent an end/side of the pool or other extending cover component, can flop onto the adjacent deck or other extending cover component, rather than the pool surface. In addition to interrupting automatic extension, if not immediately corrected manually, a flop in the wrong direction can lead to extensive damage. In particular, when the front portion of the emerging cover flexes in the topside direction, the cover folds over onto itself as the buoyancy forces accelerate extension of the remainder of the cover onto the pool surface. Folding the cover over exposes the dark undersides of the buoyant slats to the sun. Warmed by the sun, expanding air confined within the hollow slats can quickly compromise the water tightness of the slats.

SUMMARY OF THE INVENTION

A passive tensioning system for underwater buoyant-slat automatic pool cover systems that takes advantage of passive buoyancy forces involves placing/floating a buoyancy cylinder in the winding side of an underwater (pool bottom) cover drum trough, and stretching strapping fastened to the buoyancy cylinder underneath the cover roll wound up around the cover drum securing it to the opposite wall of the trough on the extension side of the cover drum. Passive buoyancy force created by the buoyancy cylinder in the winding side quadrants of the trough, stretches, tensioning the strapping around, frictionally engaging the under surface of the cover roll providing frictional resistance as the cover winds and unwinds from around the cover drum on retraction and extension for assuring that the spiraling layers of wound-up cover are, and will remain tightly wound around the cover drum.

DESCRIPTION OF PREFERRED AND EXEMPLARY EMBODIMENTS

Figure 1:
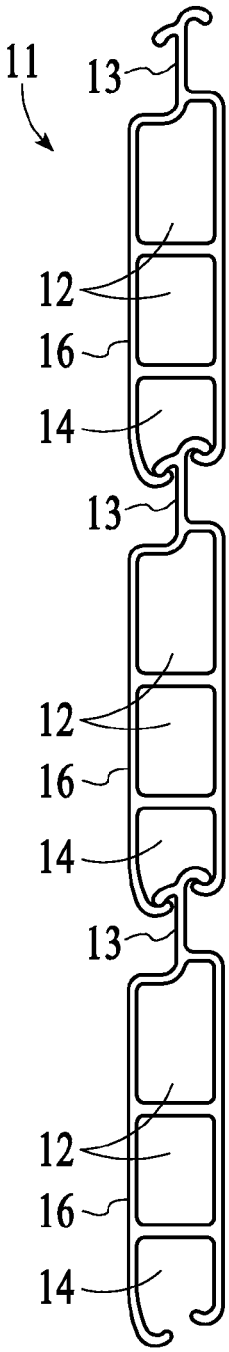
FIG. 1 shows a cross section of typical coupled longitudinal buoyant pool cover slats used by a large segment of the buoyant slat pool cover market.

Looking at FIGS. 1-5, a typical longitudinal, buoyant pool cover slat 11 comprises an extruded plastic tube having one or more longitudinal flotation chambers 12, with a longitudinal prong 13 along one side, and longitudinal female prong-receiving channel 14 along the opposite side. The extruded tubes are cut in lengths appropriate for spanning a pool surface and the ends stoppered (not shown) trapping air within the flotation chambers 12 [See U.S. Pat. No. 5,732,846, Helge]. As pointed out above, the underside 16 of the slats 11 are typically a dark color while the topside is transparent. This allows for solar heating of a covered pool, with water convection cooling the dark under side to prevent over heating compromising water tightness due to trapped air and materials expansion. The longitudinal male prongs of the slats 11 are interleaved into the longitudinal female prong-receiving channel 14 of adjacent slats 11 for forming a flexible cover that can be wound around a cover drum.

Figure 4:
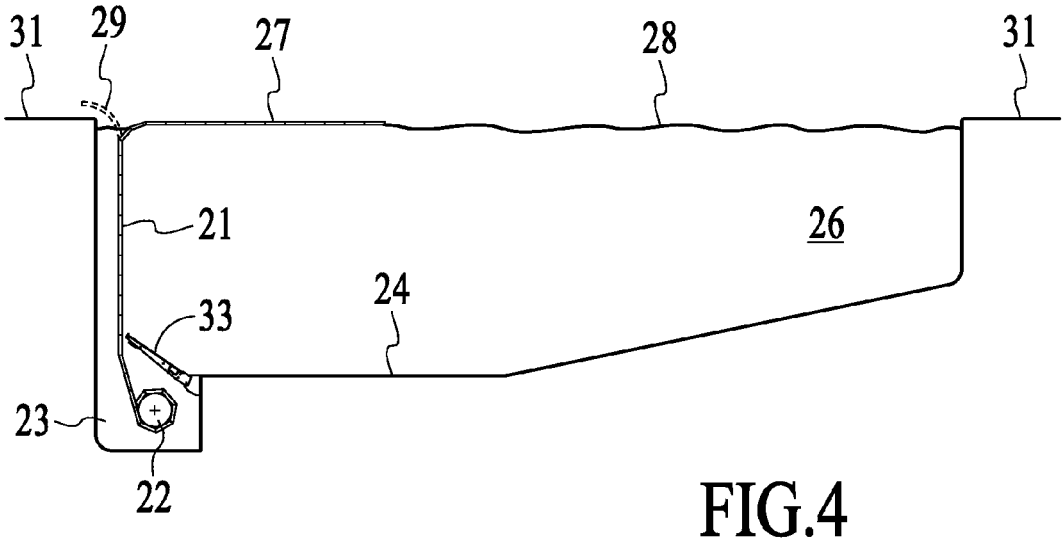
FIG. 4 shows a cross section of a pool with a pool cover trough at one end of the pool from which a buoyant-slat pool cover unwinding from a cover drum is deploying.
Figure 5:
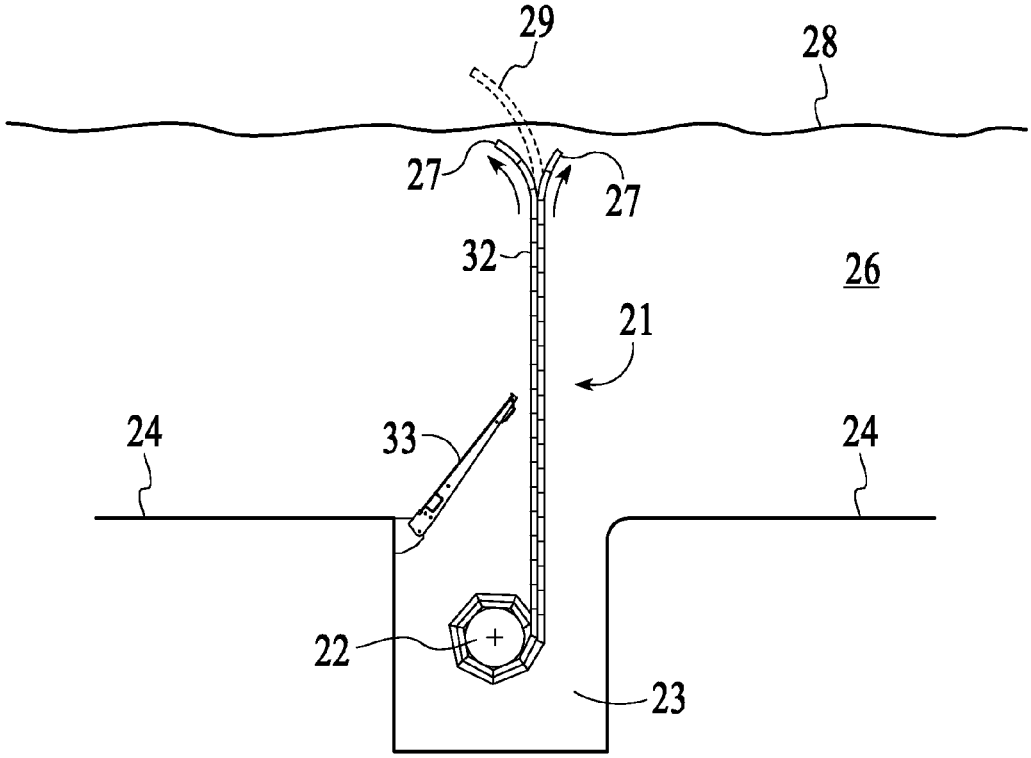
FIG. 5 shows the cross section of a central pool cover trough located beneath below the pool bottom from which dual extending components of a buoyant-slat pool cover are deploying constrained to flex in opposite directions onto the pool surface and float in opposite directions to cover the pool.

With reference to FIGS. 1, 4 and 5 as previously explained, in most circumstances, buoyancy forces acting on coupled buoyant slats 11 forming a pool cover 21 underwater, tension the couplings between adjacent slats 11 such that the prongs 13 of one slat 11 engages the inside shoulders of the female prong-receiving channel 14 of the adjacent slat 11, i.e., the couplings are extended (See FIG. 1) However, when the coupled slats reach the pool surface 28, buoyancy forces cease acting on the couplings and oppositely directed gravity forces take over causing the prongs 13 of slats 11 to transversely slide into the female prong-receiving channels 14 of adjacent slats 11. Momentum of the cover 21 accelerated by buoyancy forces acting on the underwater portion of the cover 21 below the emerging portion likewise will cause the prongs 13 of slats 11 to transversely slide into the female prong-receiving channels 14 of adjacent slats 11 as gravity decelerates the emerging portion of the cover 21 at the pool surface 28.

In short, dynamics at the leading tongue section 27 of a buoyant slat pool cover 21 emerging through a pool surface 28 are not predictable. The couplings between adjacent slats 11 in the emerging tongue section 27 are loosened and gravity acts to redirect momentum of the emerging cover flexing or bending the couplings between adjacent slats 11. If the couplings of the emerging tongue section 27 of the cover 21 flex or bend in the topside direction (illustrated in ghost at 29), the tongue section 27 will be propelled by buoyancy and gravity onto the pool deck 31 (FIG. 4) or onto an adjacent, oppositely extending pool cover element 32 (FIG. 5). The downstream (underwater) remainder of the cover 21 will follow, resulting in a catastrophic failure. However, if the couplings of the emerging tongue section 27 of the cover 21 flex or bend in the underside direction the tongue sections 27 will be propelled by buoyancy and gravity onto the pool surface 28 as illustrated, and the remainder of the cover 21 will follow.

In more detail, the longitudinal junctions or couplings between adjacent slats 11 are not snug but rather, are loose allowing the prongs 13 to move transversely within the female prong-receiving channels 14. This enables adjacent coupled slats 11 to flex around the longitudinal coupling relative to each other. With reference to a horizontal 'flotation' plane of a buoyant-slat pool cover, the male prongs 13 and female prong-receiving channels 14 of the slats 11, as designed, typically allow for topside flexure above such horizontal reference plane, upward of approximately 30°, and for underside flexure below such horizontal reference plane, downward of approximately 45°.

Figure 2:
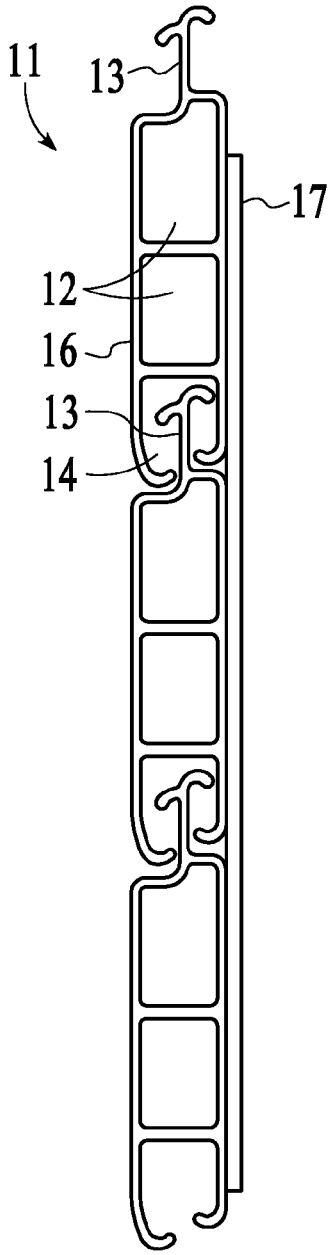
FIG. 2 shows the cross section of the typical coupled buoyant pool cover slats compressed together and constrained by a sheet of vinyl or other suitable flexible material stretched and adhered/fastened to the underside of the slats.
Figure 3:
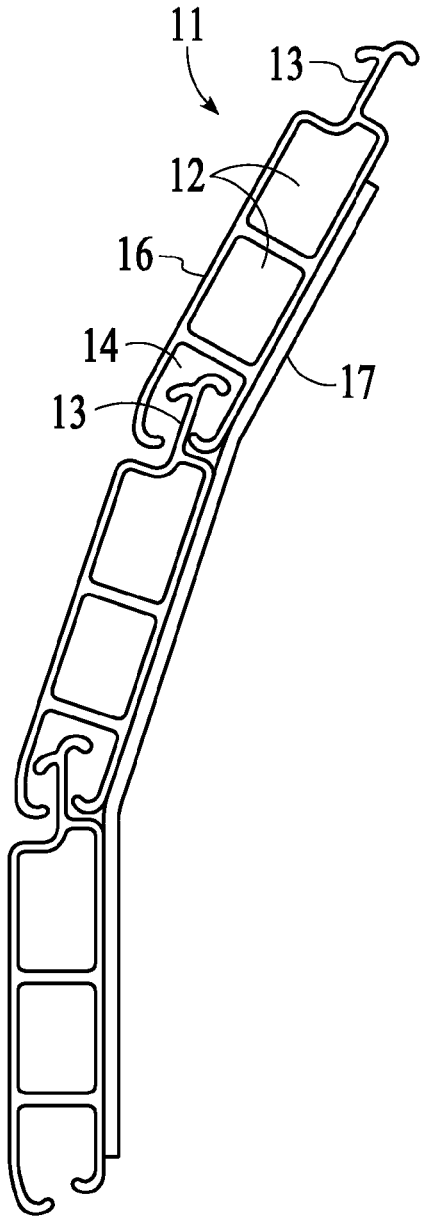
FIG. 3 shows the cross section of the typical coupled buoyant pool cover slats compressed together and constrained by a sheet of vinyl or other suitable flexible material stretched and adhered/fastened to the underside of the slats allowing flexing in a permitted direction only.

Turning now to FIGS. 2 and 3, the invented technique described in Parent application Ser. No. 10/980,533 (now U.S. Pat. No. 7,409,723) for eliminating bi-directional flexure properties of coupled buoyant pool cover slates is accomplished by compressing adjacent couple slats 11 together and securing them by fastening/adhering sheet of vinyl material 17 or other suitable flexible material to the underside surfaces 16 of the compressed together slats 11. When compressed together, the prong side shoulders 18 of the flotation chamber 12 of each slat 11 resiliently push against the shoulders 19 of the female prong-receiving channel 14 on the adjacent slat 11 tensioning the vinyl material 17 once the bond between the vinyl sheet 17 and the underside 16 of the slats 11 sets. Alternatively, the vinyl material 17 can be stretched or pre-tensioned as it is fastened to the underside 16 of the slats 11 so that once the bond has set, the sheet 17 pulls the adjacent slats together. The vinyl sheet 17 adhered to the underside 16 of the slats 11 effectively tensions or restrains (biases) the underside of the particular section of the buoyant pool cover for resisting bending or flexure of the cover in the topside direction, but allows flexure or bending of the couplings between adjacent slats in the underside direction. (See FIG. 3.)

Figure 8:
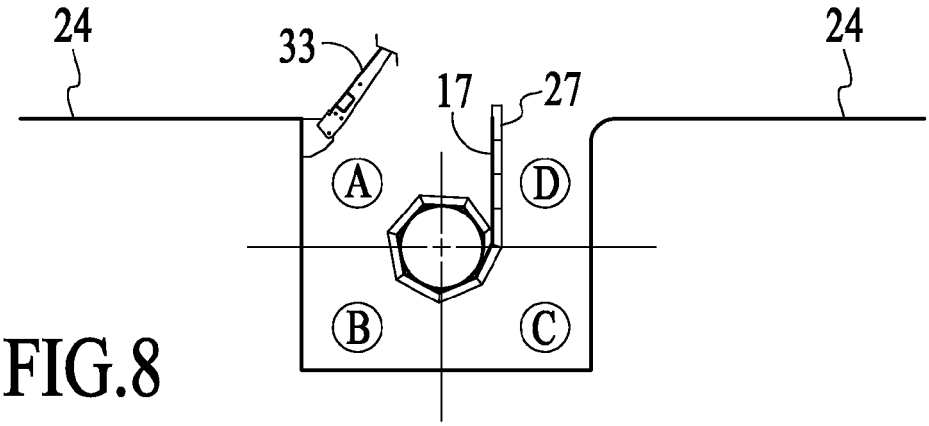
FIG. 8 shows a cross section end view of a buoyant-slat pool cover spirally wound around a cover drum within a pool cover trough below the bottom of a pool divided into quadrants A, B, C and D.

Compressing adjacent buoyant slats 11 together has the added advantage of increasing buoyancy per unit length in the compressed together region of the formed cover over that in uncompressed regions. In particular, looking at FIG. 8, a cross section end view of a buoyant-slat pool cover 21 spirally wound around a cover drum 22 within a pool cover trough 23 below the bottom surface 24 of a pool 26 is divided into quadrants A B C and D. Quadrants A and B are on the winding side of the trough 23, and quadrants C and D on the extension side. A sheet of vinyl material 17 is fastened to the underside of the front end or tongue section 27 of the cover 21 compressing the buoyant slats of in that section together. Assuming, the slats of the cover 21 are identical, and the cover is rectangular, the cover, in the tongue section 27 will have greater buoyancy per unit length (greater number of slats per meter) than the cover downstream from the tongue section. Greater buoyancy forces acting on the cover on the extension side of the trough 23 (quadrants C and D) than on the winding side of the trough 23 (quadrants A and B), tensions the cover 21 and keeps it tightly wound around the cover drum 22. This means that lengths of cover winding and unwinding for each sequential cover drum revolution on cover retraction and extension cycles, will not significantly vary between different opening and closing cycles. The ability to reliably correlate cover drum rotations to length of cover unwound and/or wound allows for automatic control of both cover extension and retraction using set points and limit switches.

Figure 6:
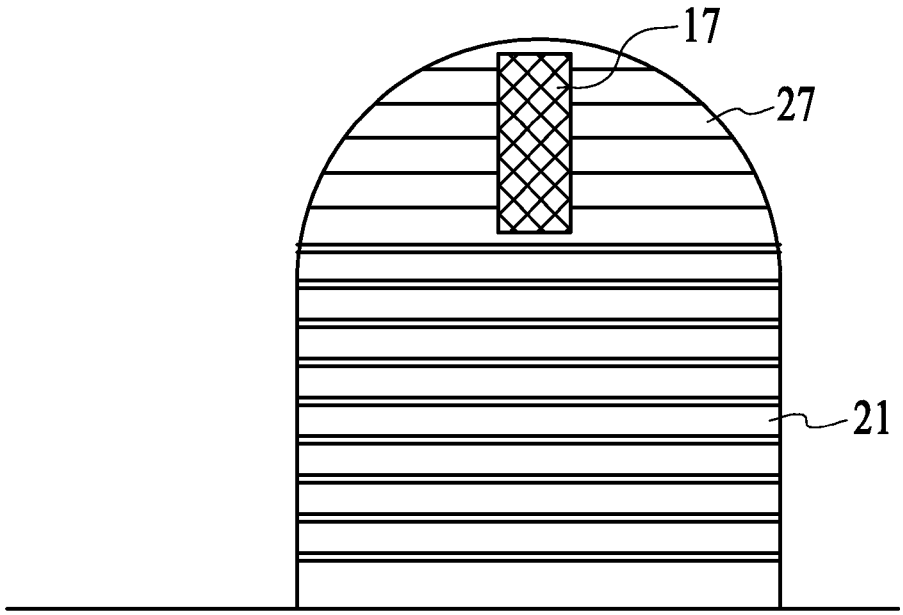
FIG. 6 illustrates a cover shaped to fit a rounded end swimming pool having a rounded tongue section of coupled buoyant pool cover slats constrained, compressed together by a vinyl or other suitable flexible material stretched and fastened to the underside of the slats increasing buoyancy of the tongue section, while assuring the round front end portion of the cover flexes or bends in the downside direction as it emerges onto the pool surface for travel toward the rounded end of the pool.
Figure 7:
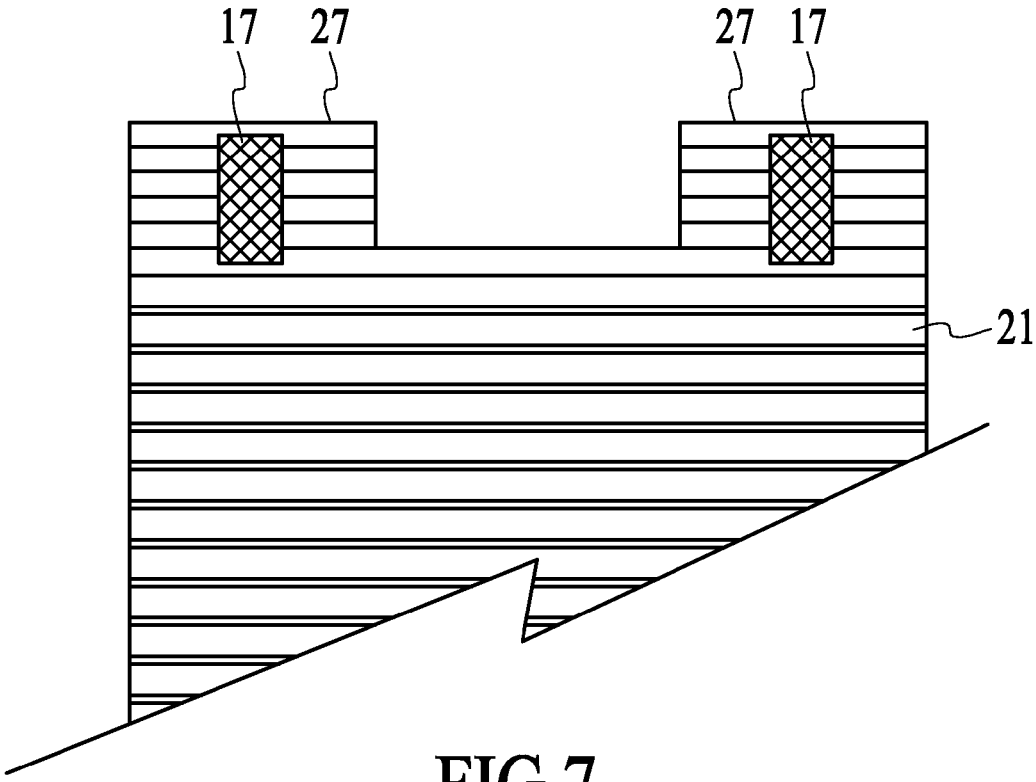
FIG. 7 illustrates yet another shape of pool cover for a pool with a peninsula end having two small leading or front sections where the coupled buoyant pool cover slats are constrained compressed together by a vinyl or other suitable flexible material stretched and fastened to the underside of the slats to assure that the two front sections flex or bend in the proper direction as they emerge onto the pool surface for travel toward the peninsula end of the pool.

This divisional application addresses those instances where the front end or tongue section 27 of the cover 21, even with the slats compressed together by a vinyl sheet do not provide sufficient buoyancy to overcome that of the outer layer of slats on the winding side (quadrants A & B) of the cover drum trough 23. In these instances the tongue section 27 of the cover 21 is either not as wide as the remainder of the cover as shown in FIG. 6 where the tongue section is semi-circular (has a declining width) or does not have the same volume as the remainder of the cover as shown in FIG. 7 where the central portion of the cover tongue 27 is cut out to accommodate a peninsula or other protrusion at the pool end (not shown).

The typical solution of simply letting the smaller volume tongue section 21 extend upward from portion of the cover 21 wound around the cover drum 22 is not feasible particularly when a lid 33 over the cover drum trough is desirable or required for isolating the fully retracted, stored cover 21 from swimmers recreating in the pool.

It also should be appreciated, as previously pointed out, for limit switch set point control of pool cover extension and retraction, the revolutions of the cover drum 22 must be reliably correlated with the length of the buoyant pool cover 21 as the buoyant slat pool cover 21 unwinds from and winds up around a cover drum 22 in extension-retraction cycles.

To explain, suitable limit switching systems conventionally count rotations of a cover drum shaft using a rotary or shaft encoders or similar mechanism and switch to interrupt or supply power to arrest and hold shaft rotation based on counted shaft revolutions or set points. Mathematically, it is possible to calculate a correlation between a rotation and/or rotations of a cover drum and the length of cover 21 wound or unwound from around the cover drum 22 using formulas for Archimedean or arithmetic spirals in that successive turnings of a cover roll spiral, ideally could have a constant separation distance, i.e. the thickness of the buoyant slats. 11.

(See Wikipedia at http://en.wikipedia.org/wiki/Archimedeanspiral#Characteristics) and Wolfram Mathworld at http://mathworld.wolfram.com/ArchimedesSpiral.html.)

However, as also pointed, out buoyancy forces underwater tend to turn a submerged, buoyant slat pool cover spirally wound around a cover drum in the direction of the side with the greater buoyancy. In instances as shown in FIGS. 6 & 7 where, for example, the cover tongue section 27 is confined beneath a closed trough lid 33 (FIG. 8) and does not have sufficient buoyancy to overcome that of the outer layer of slats on the winding side (quadrants A & B), the buoyancy forces will spirally unwind, radially expanding the cover roll pulling the cover tongue section 27 around the cover roll in the winding direction, successively until the buoyancy forces on the respective sides (layers) of the cover roll balance (reach an equilibrium) or the cover roll radially expands to the cover trough walls. Such passive unwinding or spiral loosening of the retracted cover roll in the cover drum trough effectively precludes limit switch/set point control for automatic cover extension because the length of cover extended can no longer be correlated to rotations of the cover drum shaft.

The passive tensioning system for underwater buoyant-slat automatic pool cover systems of this divisional application enables buoyant slat pool covers to be fully wound around a submerged cover drum and stored beneath a trough lid 33 below the bottom of a pool.

Figure 9:
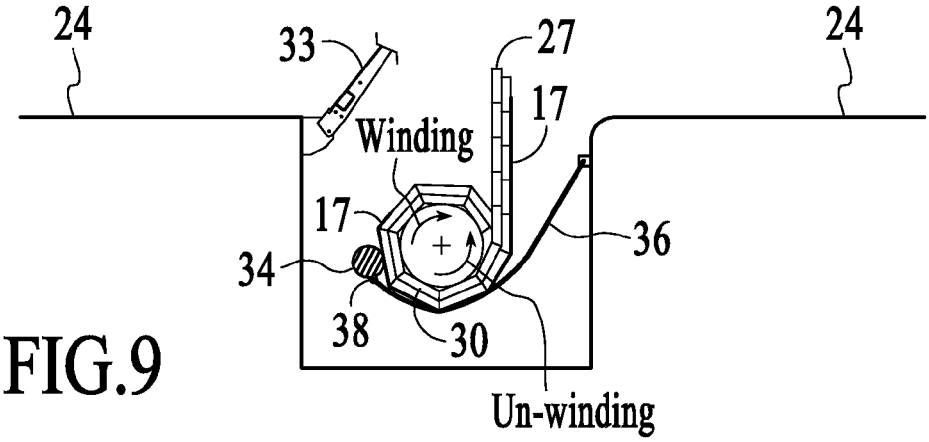
FIG. 9 shows a cross section end view of a buoyant-slat pool cover spirally wound up around a cover drum within a pool cover trough below the bottom surface of a pool with a buoyancy cylinder floating in the winding side quadrants A and B of the trough held by strapping stretched underneath the cover and drum and fastened to the upper edge of the opposite wall of the trough in the extension side quadrants C & D of the trough.
Figure 10:
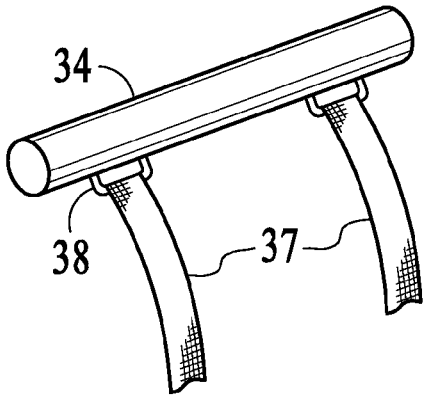
FIG. 10 is a perspective view showing the buoyancy cylinder, strapping bales and suitable strapping fastened to the bales.

As shown, in FIG. 9 a buoyancy cylinder 34 is located completely submerged, buoyed upward in the winding side (quadrants A & B) of the cover drum trough 23 secured by a sheet 36 of flexible strapping material (FIGS. 6 & 9) or separated straps 37 (FIGS. 7 & 10) stretched down underneath the cover roll 30 and cover drum 22, then up to near the top edge of the opposite wall where the respective distal ends of the strapping sheet 36 or straps 37 are fastened near the top edge on the extension side (quadrants C & D) of the cover drum trough 23. The strapping sheet 36 or separated straps 37 pulled by the buoyant force passively created by the buoyancy cylinder 34 in quadrants A & B provide radial forces frictionally engaging the underside surface of the cover roll 30 braking (resisting) its movement as the cover 21 winds up and unwinds from around the cover drum 23.

It should be noted that the area of friction engagement between the cover drum roll and webbing/straps 36/37, and the buoyant force provided by the buoyancy cylinder 34 moving up and down in the cover drum trough 23 both increase as the radius of the cover roll 30 increases.

In more detail flexible strapping sheet 36 (FIG. 9) or separated straps 37 (FIG. 10) stretching underneath the cover roll 30 and cover drum 22 are passively tensioned by the buoyancy force due to the buoyancy cylinder 34 (determined by the displacement of the buoyancy cylinder 34 and its depth below the pool surface) induce the sheet and/or straps to frictionally engage the underneath surface of the cover roll 30 to counter or resist forces tending to wind or unwind the spirally wound layers of the cover 21. The buoyancy force tensioning the sheet and or straps should provide sufficient frictional resistance to counter buoyancy forces acting on the cover slats 11 that would radially expand or loosen the spiraling cover roll 30 as it winds up and unwinds from around the cover drum 22. The frictional resistance provided by the tensioned strapping sheet 36 or separated straps 37 also complements the buoyancy tensioning the cover 21 extending up from the trough 23 for effectively maintaining extension of the couplings between adjacent slats 11 of the cover 21 as the cover winds up and unwinds from around the cover drum 22.

Also, it should be appreciated that the surface of the buoyancy cylinder 34 will come into contract with and wear the surface of the cover roll 30 at some point as its radius increases as the cover 21 is wound onto the cover drum 22. Accordingly, as illustrated the webbing/straps 36/37 are preferably secured to bales 38 (FIG. 10) radially extending from the buoyancy cylinder 34 such that the webbing/strapping 36/37 material is not located between the moving surface of the winding/unwinding cover 21 and the stationary surface of the buoyancy cylinder 34. It is also possible to mitigate deleterious effects of contact wear between the surface of the buoyancy cylinder 34 and buoyant slats 11 forming cover 21 again by adhering/securing sheet of vinyl material 17 (whether or not compressing) to the underside surface of the slats 11 forming the cover 21 where the underside surface of the cover is the outside surface of the cover roll 30 (see FIG. 9).

While it may be possible to mathematically calculate a correlation between a rotation and/or rotations of a cover drum and the length of cover 21 wound/unwound from around a submerged cover drum 22, as a practical matter it is not necessary. In particular, with the passive tensioning system in place and the pool filled with water, a correlation between rotations of the cover drum 22 and length of cover 27 deployed/retracted can be empirically determined.

To explain, the cover 21 can be deployed from the pool bottom, cover drum trough 23 to the fully extended position and latched or anchored to an end pool edge, i.e., unwound from around the cover drum 22 completely covering the pool surface and fastened to the pool edge at the extended end of the cover 21. The cover drum 22 rotation is then reversed to slightly extend the couplings between adjacent slats 11. The cover 21 is then unlatched from the fully extended position (released), and using the rotary or shaft encoder of a conventional limit switch system, to measure or count winding rotations of the shaft rotating the cover drum 22, the cover 21 is wound up around the cover drum 22 to the storage position where its leading edge just enters the pool bottom trough 23, and the trough lid can close with out interference, thus, establish an initial retraction set point $R_R$ at the number of winding revolutions ($R_{iw}$) of the cover drum shaft counted. The cover 21 is again deployed to the fully extended position, this time counting the unwinding revolutions ($R_{uw}$) of the cover drum shaft stopping when $R_{uw}=R_{iw}$. At that point the installer can determine how easily the cover 21 can be anchored at the pool end(s) edge(s) at the fully extended position of the cover 21, and the degree of extension of the couplings between adjacent cover slats 11. The installer can then estimate an extension set point $R_E$. The cover 21 is again wound up around the cover drum 22 to the retraction set point $R_R$ and stopped and the installer can determine whether the trough lid 33 will close without interference from the cover 21. If not the wind and unwinding steps can be successively repeated adjusting the respective retraction and extension set points $R_R$ and $R_E$ until a suitable fully extended and storage positions are repeatable at particular a retraction set point $R_R$ and a particular extension set point $R_E$.

When the cover 22 is fully wound-up around the cover drum 22, within the pool bottom trough 23 below the bottom surface 24 of the pool at the storage position set point $R_R$, the associated limit switch system stops and holds rotation of the cover drum shaft in the winding direction and prevent it from rotating in the unwinding direction. The frictional resistance provided by the strapping sheet 36 or straps 37, and the buoyancy of cover yet to be wound up combine to extend the couplings between adjacent slats 11 of the spirally wound up cover 21. (See FIG. 1). The frictional resistance provided by the strapping sheet 36 or straps 37 engaging the underside surface of the cover roll 30 also counteracts buoyancy forces inherent in the slats 11 from loosening or unspiraling in the winding direction precluding radial expansion the cover roll 30 around the cover drum 22.

Accordingly, upon deployment the cover drum shaft must initially be powered for rotation in the unwinding direction to overcome the frictional resistance of the sheet 36 or straps 37 tensioned by the buoyancy cylinder 34 until the buoyancy of the ascending unwound cover 22 rising out the extension side of the trough 23 (quadrants C and D) is sufficient to spirally unwinding the cover 21 from around the cover drum 22. When the extension set point $R_E$ for cover drum shaft rotations on cover deployment is reached, the associated limit switch system again stops and holds rotation of the cover drum shaft in the unwinding direction and prevents it from rotating in the winding direction. At the extended position, the frictional resistance of the sheet 36 or straps 37 tensioned by the buoyancy cylinder 34 again preclude the remaining cover 21 still spirally wound around the cover from loosening, and, as well, attenuates or diminishes the buoyancy force of the vertical section of the cover 22 extending up from the cover drum trough 23 to the pool surface 28 (FIGS. 4 & 5) from excessively tightening any remaining layers of the cover 21 still wound around the cover drum 22 at that point.

The invented techniques and associated mechanisms for taking advantage and utilizing passive buoyancy forces for assuring and fine tuning automatic operation of buoyant-slat pool cover systems have been described in context of both representative and preferred embodiments which have reference to automatic swimming pool cover systems invented and developed by the Applicant and others. [See Applicant's co-pending application Ser. No. 09/829,801 filed Apr. 10, 2001 entitled AUTOMATIC POOL COVER SYSTEM USING BUOYANT-SLAT POOL COVERS.] It should be recognized that skilled engineers and designers could specify different configurations for the described mechanisms implementing the invented techniques that perform substantially the same function, in substantially the same way to achieve substantially the same result as those components described and specified in this application. Similarly, the respective elements described for effecting the desired functionality could be configured differently, per constraints imposed by different mechanical systems, yet perform substantially the same function, in substantially the same way to achieve substantially the same result as those components described and specified by the Applicant above. Accordingly, while mechanical components suitable for implementing the invented techniques may not be exactly described herein, they will fall within the spirit and the scope of invention as described and set forth in the appended claims.

I claim:

1. A passive buoyancy mechanism for maintaining a correlation between length of a buoyant pool cover and revolutions of a cover drum completely submerged in a pool bottom trough around which the pool cover spirally winds and unwinds in a retraction-extension cycle comprising, in combination:

a) a buoyant cylinder completely submerged, buoyed within winding side quadrants of the pool bottom trough adjacent and parallel to the cover drum;

b) strapping fastened between the submerged buoyant cylinder and an upper, unwinding side of the pool bottom trough, tensioned by buoyant forces created by the submerged buoyant cylinder, stretching down winding side quadrants of the trough, around and underneath the spirally wound up cover, and up unwinding side quadrants of the pool bottom trough frictionally engaging exterior surfaces of the spirally wound up layers of the cover as the cover spirally winds-up and unwinds from around the cover drum for resisting radial expansion of the submerged, spirally wound layers of the buoyant wound up around the cover drum;

c) means for rotating the cover drum a specified number of revolutions in a winding direction for spirally winding the cover around the cover drum retracting the pool cover from an extended position covering a pool surface to a storage position completely submerged, spirally wound up around the cover drum in the pool bottom trough;

d) means for preventing cover drum rotation when the pool cover is spirally wound up to the storage position; and e) means for rotating the cover drum the specified number of revolutions in an unwinding direction for spirally unwinding the buoyant cover from around the cover drum extending the pool cover from the submerged, storage position to the extended position covering the pool surface.

2. A buoyant pool cover system comprising in combination, a) a pool bottom trough having a winding side and an unwinding side that extend below a bottom surface of a pool;

b) a longitudinal, rotatable cover drum secured to one end of a buoyant pool cover for spirally winding up and unwinding the buoyant pool cover, mounted in the pool bottom trough aligned parallel to the sides of the trough;

c) strapping fastened to the unwinding side of the pool bottom trough proximate the bottom surface of the pool stretching down unwinding side quadrants of the trough, underneath all submerged, spirally wound layers of the buoyant pool cover wound up around the cover drum, up winding side quadrants of the trough and secured to, and tensioned by forces created by a buoyant cylinder submerged within the winding side quadrants of the trough adjacent and parallel the cover drum frictionally engaging outside underneath surfaces of the cover as it spirally winds up and unwinds from around the cover drum for resisting radial expansion of the submerged, spirally wound up layers of the buoyant pool cover;

d) means for rotating the cover drum a specified number of revolutions in a winding direction for spirally winding the buoyant pool cover around the cover drum retracting the pool cover from an extended position covering a pool surface to a submerged storage position spirally wound around the cover drum in the pool bottom tough;

e) means for preventing cover drum rotation when the pool cover is spirally wound up to the storage position; and f) means for rotating the cover drum a specified number of revolutions in an unwinding direction for spirally unwinding the buoyant pool cover from around the cover drum extending the pool cover from the submerged storage position spirally wound up around the cover drum to the extended position covering the pool surface.

* * * * *